US006923439B2

(12) United States Patent
Hashimoto

(10) Patent No.: US 6,923,439 B2
(45) Date of Patent: Aug. 2, 2005

(54) IMAGE FORMING DEVICE

(75) Inventor: Yasushi Hashimoto, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 33 days.

(21) Appl. No.: 10/615,023

(22) Filed: Jul. 9, 2003

(65) Prior Publication Data

US 2004/0007811 A1 Jan. 15, 2004

(30) Foreign Application Priority Data

Jul. 10, 2002 (JP) ..... P2002-201055

(51) Int. Cl.[7] ..... B65H 39/10
(52) U.S. Cl. ..... 271/303
(58) Field of Search ..... 271/303, 301; 399/401

(56) References Cited

U.S. PATENT DOCUMENTS 5,131,644 A * 7/1992 DuBois ..... 271/84
5,472,185 A * 12/1995 Kollann et al. ..... 271/303
5,532,793 A * 7/1996 Kogure ..... 399/19
6,176,485 B1 * 1/2001 Wingate ..... 271/303
6,445,903 B2 * 9/2002 Hashimoto et al. ..... 399/401
6,533,271 B1 * 3/2003 Zimmermann ..... 271/303

FOREIGN PATENT DOCUMENTS

JP 59-230955 * 12/1984
JP 4-148763 * 5/1992
JP 5-286627 * 11/1993

* cited by examiner

*Primary Examiner*—David H. Bollinger
(74) *Attorney, Agent, or Firm*—McGuireWoods LLP

(57) ABSTRACT

An image forming device includes an upstream-side sheet transport pathway, a plurality of downstream-side sheet transport pathways, and a pathway switching mechanism. The plurality of downstream-side sheet transport pathways diverge from the upstream-side sheet transport pathway at a divergence point. At the divergence point, the pathway switching mechanism selectively guides sheets that were transported following the upstream-side sheet transport pathway to one of the plurality of downstream-side sheet transport pathways. The pathway switching mechanism includes a pair of upstream-side gate members and a gate member pivoting unit. The pair of upstream-side gate members include a pair of pivot shafts and a pair of gates. The pair of pivot shafts are disposed with the sheet transport pathway interposed therebetween. Each of the pair of gates is pivotable around a corresponding one the pair of pivot shafts and extends substantially toward the downstream-side sheet transport pathways. The gate member pivoting unit pivots the pair of gates substantially simultaneously and substantially in the same direction.

17 Claims, 5 Drawing Sheets

IMAGE FORMING DEVICE

BACKGROUND OF THE INVENTION

1. Field of the Invention

The present invention relates to an image forming device such as a printer or a copy machine, and more particularly to an image forming device that transports cuts sheets one at a time and that includes a transport pathway switching mechanism that guides the cut sheets selectively toward a sheet-discharge pathway and toward a sheet turn-over/resupply transport pathway.

2. Description of Related Art

There has been known a conventional printer capable of printing on both sides of the same sheet. The printer includes a transport pathway switching unit for switching transport pathway of sheets. The pathway switching unit is located downstream from an image fixing unit and other image forming components for forming an image on one side of a sheet. The pathway switching unit selectively guides sheets from the image fixing unit toward either a discharge pathway or a return pathway. The discharge pathway leads to a stacker or other such post-image-formation processing unit. The return pathway leads back toward the image forming section of the printer so that an image can be formed on the other side of the sheet.

FIGS. 1 and 2 show a sheet transport switching mechanism used in a conventional image forming device. A sheet transport pathway 112 connects a fixing unit (not shown) with a return pathway 114 and a sheet discharge pathway 113. The return pathway 114 connects with the sheet transport pathway 112 at a divergence point P. The return pathway 114 is used to guide sheets back to the image forming section during two-side printing. A pivot shaft 152 is provided in the sheet transport pathway 112 at a position downstream from the divergence point P. A path gate 150 extends from the pivot shaft 152 toward an upstream side of the transport pathway. It should be noted that the divergence point P is located at the same position as the free end of the path gate 150. Also, sheet guides 135, 136, 137, and 138 are fixed to a main casing (not shown) and define the sheet transport pathway 112 and the return pathway 114.

FIG. 1 shows the path gate 150 pivoted counterclockwise for guiding sheets toward the return pathway 114. FIG. 2 shows the path gate 150 pivoted clockwise for guiding sheets toward the sheet discharge pathway 113, which leads to a stacker or other post-image forming unit (not shown). A gate arm 158 is formed integrally with the pivot shaft 152 at the opposite side of the pivot shaft 152 than the path gate 150. In order to pivot the path gate 150 either forward or backward, a stepping motor 154 is rotated a predetermined number of steps in the corresponding direction. Rotation of the stepping motor 154 is transmitted to a gate cam gear 156 through a motor gear 155. A cam roller 157 attached to the gate cam gear 156 rotates accordingly. A pulling spring 159 urges the gate arm 158 into abutment with either the cam roller 157 as shown in FIG. 1 or a stopper 156A as shown in FIG. 2 depending on the rotation angle of the gate cam gear 156.

When the stepping motor 154 rotates the gate cam gear 156 clockwise (with respect to the view of FIG. 1) by a predetermined amount from the position shown in FIG. 2, then the cam roller 157 moves downward into the position shown in FIG. 1. As a result, the gate arm 158 pivots counterclockwise and the path gate 150 moves into a posture for blocking the sheet discharge pathway 113 and guiding sheets toward the return pathway 114. A sheet sensor 153 is provided upstream from the divergence point P. The sheet sensor 153 detects when the trailing edge of a sheet passes by the sheet sensor 153. A calculation unit of a control system (not shown) uses this detection to calculate when the trailing edge of the sheet will pass by the path gate 150.

The path gate 150 is maintained in the position shown in FIG. 1 if the next sheet from the sheet transport pathway 112 is also to be sent to the return pathway 114. However, if the next sheet is to be sent to the sheet discharge pathway 113, then rotation of the stepping motor 154 is reversed when the trailing edge of the preceding sheet is determined to have passed by the path gate 150. When the stepping motor 154 rotates in the opposite direction, the gate cam gear 156 also rotates in reverse and the gate arm 158 pivots clockwise as viewed in FIG. 2 until the gate arm 158 abuts against the stopper 156A. At this time, the path gate 150 also pivots clockwise into the position shown in FIG. 2 for blocking the entrance to the return pathway 114 and for guiding sheets toward the sheet discharge pathway 113. The path gate 150 will have pivoted into the position shown in FIG. 2 before the subsequent sheet reaches the path gate 150, thereby opening up the newly selected transport pathway and blocking the other transport pathway so that the subsequent sheet can be guided toward the newly selected transport sheet.

SUMMARY OF THE INVENTION

The sheet must pass entirely by the path gate 150 before the path gate 150 can be switched. Because the path gate 150 is located downstream from the divergence point P, the path gate 150 cannot be pivoted for a period of time after the trailing edge of the sheet passes by the front end of the path gate 150 until the trailing edge of the sheet completely passes by the rest of the path gate 150. On the other hand, the path gate 150 must be completely pivoted into the other guiding posture during the time from when the trailing edge of the preceding sheet completely passes by the path gate 150 to before the leading edge of the subsequent sheet reaches the path gate 150.

In order to increase the printing speed increased without changing the distance that sheets are transported, then the time interval between the trailing edge of a preceding sheet and the leading edge of a subsequent sheet must be reduced. In this case, it is necessary to reduce the time required to pivot the path gate 150. However, when sheet transport is delayed in the image forming section for some reason, such as the sheet slipping during transport there, the path gate 150 may start moving before the preceding sheet has completely passed by the path gate 150. As a result, the preceding sheet may become pinched between the path gate 150 and the sheet guides 135, 136, 137, and 138 that form the transport pathway. This pinching action can damage the sheet.

Even if the path gate 150 starts moving only after the preceding sheet completely passes by the path gate 150, the leading edge of the subsequent sheet can snag on the front end of the path gate 150 if the subsequent sheet reaches the front end of the path gate 150 before the path gate 150 completely stops pivoting. This can result in a paper jam.

In order to overcome the above-described problems, it is conceivable to increase both the transport distance of sheets and the transport speed when increasing the printing speed. This would increase the time interval between successive sheets. However, such a conceivable configuration would require a larger motor for driving the transport mechanism at the faster transport speed. The larger motor would increase the size and cost of the printer.

Alternatively, it is conceivable to increase the rotational speed of the stepping motor 154 in association with increase in printing speed so that the path gate can be pivoted more rapidly. However, such a faster stepping motor 154 would increase the cost of the printer.

It is an objective of the present invention to overcome the above-described problems and to provide mechanism for switching sheet transport path in an image forming device using a gate member wherein the gate member has sufficient time to move even when sheet transport distance and transport speed are minimal.

In order to achieve the above-described objective, an image forming device according to the present invention includes an upstream-side sheet transport pathway, a plurality of downstream-side sheet transport pathways, and a pathway switching mechanism. The plurality of downstream-side sheet transport pathways diverge from the upstream-side sheet transport pathway at a divergence point. At the divergence point, the pathway switching mechanism selectively guides sheets that were transported following the upstream-side sheet transport pathway to one of the plurality of downstream-side sheet transport pathways. The pathway switching mechanism includes a pair of upstream-side gate members and a gate member pivoting unit. The pair of upstream-side gate members include a pair of pivot shafts and a pair of gates. The pair of pivot shafts are disposed with the sheet transport pathway interposed therebetween. Each of the pair of gates is pivotable around a corresponding one the pair of pivot shafts and extends substantially toward the downstream-side sheet transport pathways. The gate member pivoting unit pivots the pair of gates substantially simultaneously and substantially in the same direction.

BRIEF DESCRIPTION OF THE DRAWINGS

The above and other objects, features and advantages of the invention will become more apparent from reading the following description of embodiments taken in connection with the accompanying drawings in which.

DETAILED DESCRIPTION OF THE EMBODIMENTS

Figure 1:
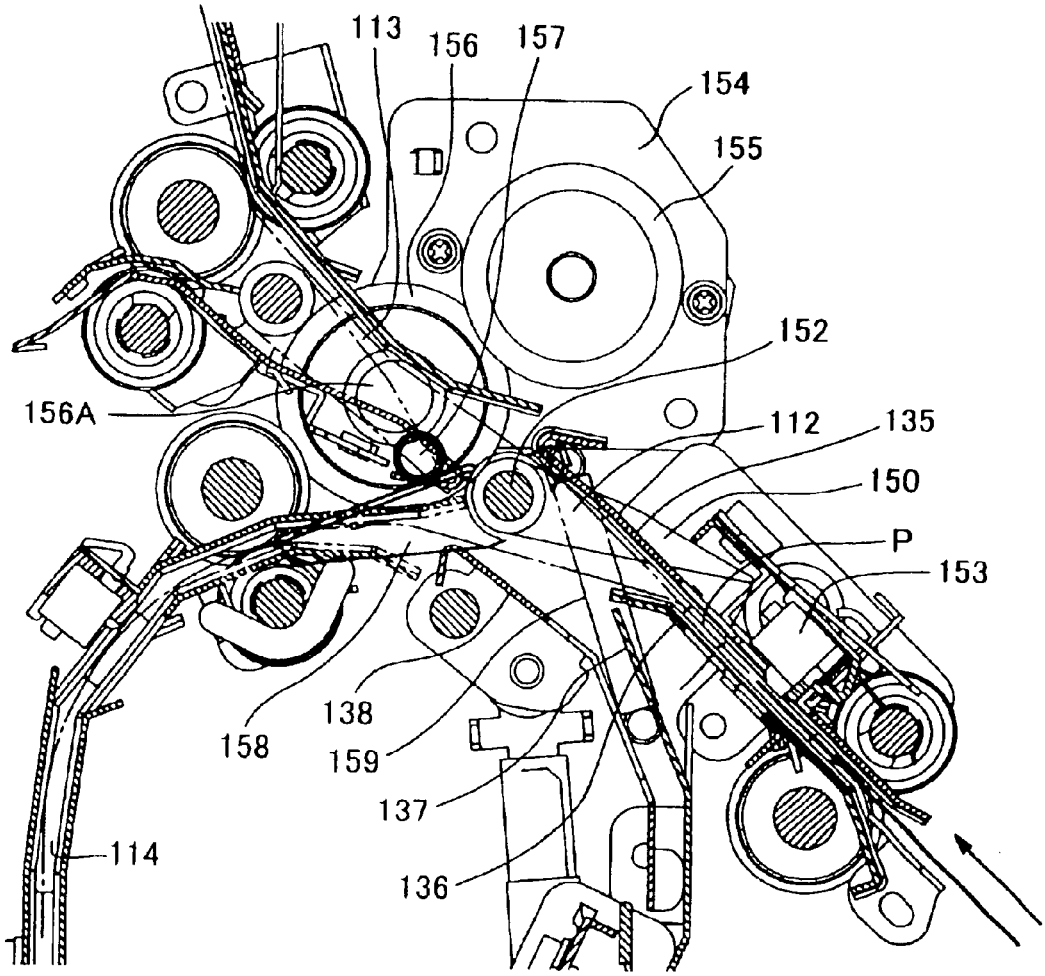
FIG.1 PRIOR ART
FIG. 1 is a side view showing a conventional transport pathway switching mechanism in a condition for guiding sheets toward a sheet return pathway.
Figure 2:
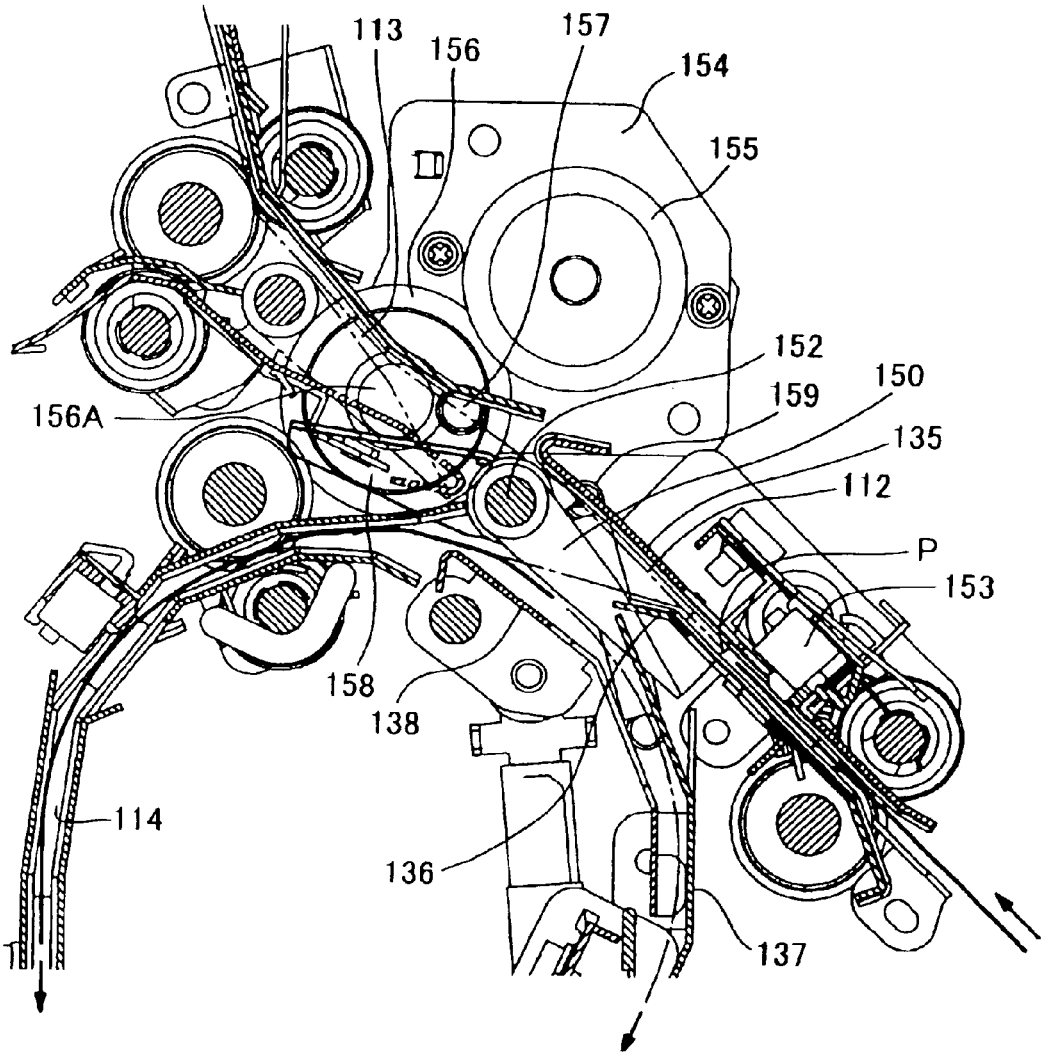
FIG.2 PRIOR ART
FIG. 2 is a side view showing the conventional transport pathway switching mechanism of FIG. 1 in a condition for guiding sheets toward a sheet discharge pathway.
Figure 3:
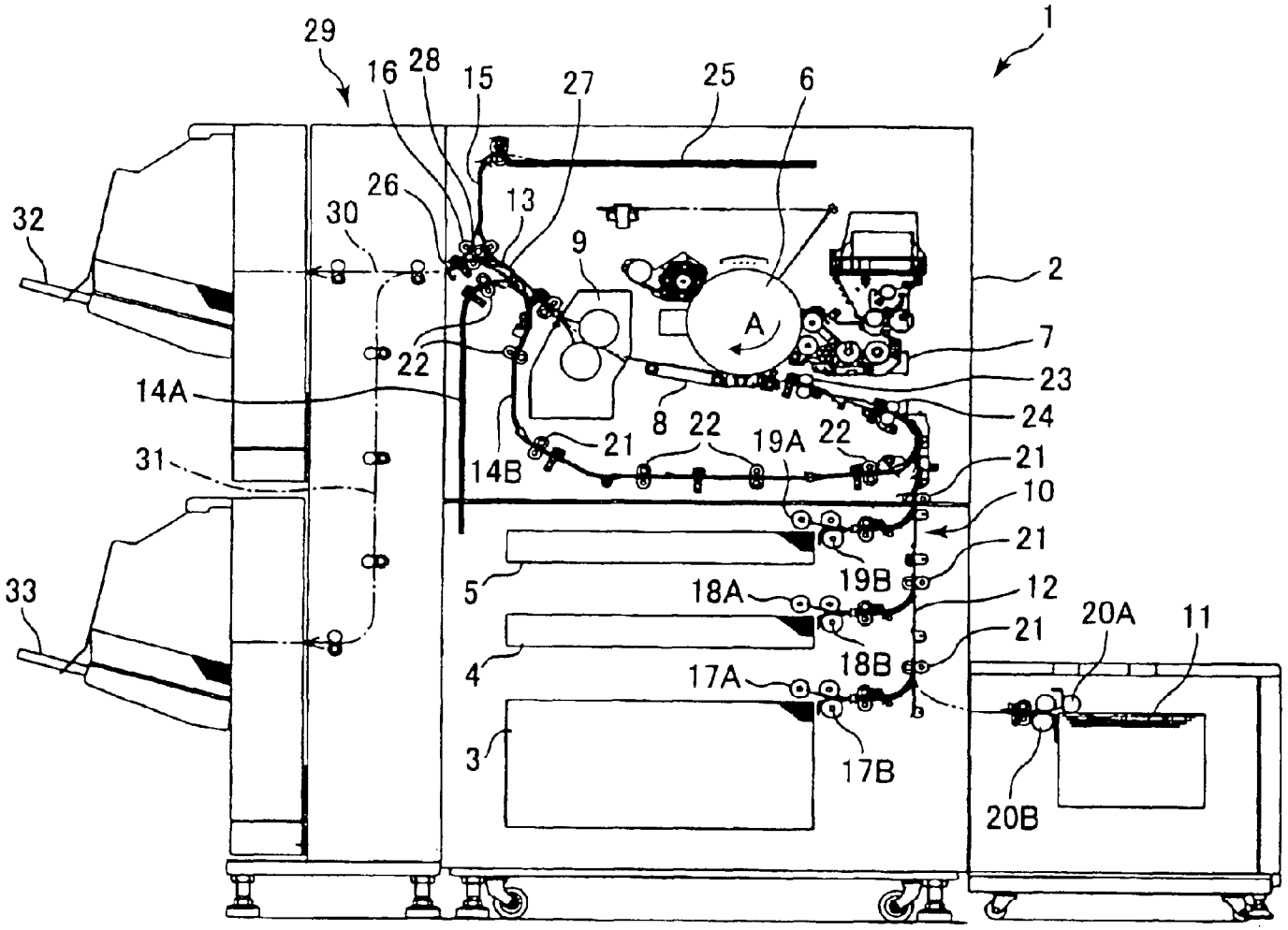
FIG. 3 is a side view partially in cross-section showing a printer according to an embodiment of the present invention.

Next, a printer according to an embodiment of the present invention will be described based on FIGS. 3 to 5. As shown in FIG. 3, the printer includes an image forming section 1 and a sheet handling section 29. The image forming section 1 is a laser printer including a photosensitive drum 6 to form toner images on sheets using well-known electrophotographic processes. The sheet handling section 29 is a stacker that stacks sheets discharged from the image forming section 1 onto trays.

The image forming section 1 includes a main casing 2. A plurality of sheet holding units 3, 4, 5 are aligned one on top of each other in the lower section of the main casing 2. The sheet holding units 3, 4, 5 hold sheets on which the image forming section 1 forms images. A photosensitive drum 6 is provided above the sheet holding units 3, 4, 5. The photosensitive drum 6 is supported rotatable in the direction indicated by arrow A in FIG. 3 based on signals from a controller (not shown). A corona charging unit (not shown), an exposure unit (not shown), a developing unit 7, and a transfer unit 8 are disposed around the photosensitive drum 6. The corona charging unit is for charging the surface of the photosensitive drum 6 to a uniform charge. The exposure unit is for irradiating the surface of the photosensitive drum 6 with a laser beam that corresponds to the image to be printed. The developing unit 7 is for supplying toner to the photosensitive drum 6. The transfer unit 8 is for transferring a toner image from the photosensitive drum 6 onto a sheet. A fixing unit 9 is disposed downstream from the transfer unit 8. The fixing unit 9 is for fixing the transferred toner image onto the sheet.

When the photosensitive drum 6 starts to rotate, the corona charging unit charges the surface of the photosensitive drum 6 to a uniform charge as the photosensitive drum 6 rotates. The exposure unit emits a laser beam that forms an electrostatic latent image on the charged surface of the photosensitive drum 6. When the electrostatic latent image reaches the developing unit 7, the developing unit 7 develops the electrostatic latent image into a visual toner image by toner on the surface of the photosensitive drum 6. The transfer unit 8 operates to move the toner image formed in this way onto a sheet feed out from one of the sheet holding units 3, 4, 5 or from return pathways 14A, 14B to be described later. The fixing unit 9 includes a thermal roller and a pressure roller in pressing contact with each other. The fixing unit 9 fixes the transferred toner image onto the sheet. Hereinafter, the photosensitive drum 6, the developing unit 7, and the transfer unit 8 will be referred to collectively as an image forming section.

Next, an explanation will be provided for a sheet transport pathway 10. The sheet transport pathway 10 includes a sheet-feed pathway 12, a sheet-discharge pathway 13, the return pathways 14A, 14B, a face-down pathway 15, and a face-up pathway 16. The sheet-feed pathway 12 extends from the sheet holding units 3, 4, and 5 and an externally attached sheet holding unit 11 and passes by the image forming section and the fixing unit 9. The sheet-discharge pathway 13 diverges upward from the sheet-feed pathway 12. The return pathways 14A, 14B diverge downward from the sheet-feed pathway 12. The face-down pathway 15 diverges upward from the sheet-discharge pathway 13 and discharges sheets with the printed surface facing downward onto a sheet tray 25. The face-up pathway 16 diverges downward from the sheet-discharge pathway 13 and discharges sheets with the printed surface facing upward. The face-up pathway 16 is connected to an opening 26 of the main casing 2.

The return pathways 14A, 14B include a first return pathway 14A and a second return pathway 14B. The second return pathway 14B is connected to the first return pathway 14A. During a two-side printing operation, a sheet that is formed on one surface with a toner image is temporarily fed into the first return pathway 14A after passing through the fixing unit 9. The sheet is then transported into and out of the first return pathway 14A and then into the second return pathway 14B, which guides the sheet back to a position upstream from the image forming section.

A pick-up roller 17A and a pair of sheet-feed rollers 17B are provided adjacent to the sheet housing portion 3.

Similarly, pick-up rollers 18A, 19A, and 20A and pairs of sheet-feed rollers 18B, 19B, 20B are provided adjacent to the sheet housing portion 4, 5, 11, respectively. The pick-up rollers 17A, 18A, 19A, and 20A are for picking up the uppermost sheet from the stack in the corresponding sheet housing portion 3, 4, 5, 11. Each of the pairs of sheet-feed rollers 17B, 18B, 19B, 20B includes a feeder roller and a retarder roller and function to supply the sheets fed out by the pick-up rollers 17A, 18A, 19A, and 20A, respectively, to the sheet-feed pathway 12 one at a time while preventing the fed-out sheets from being supplied to the sheet-feed pathway 12 more than one at a time.

A plurality of roller pairs 21 are disposed along the sheet-feed pathway 12 at positions upstream from the position where the second return pathway 14B merges with the sheet-feed pathway 12. A plurality of transport roller pairs 22 are provided following the first return pathway 14A and the second return pathway 14B. A pair of registration rollers 23 and a pair of timing rollers 24 are provided on the sheet-feed pathway 12 at positions in between the image forming section and a position downstream from where the second return pathway 14B merges with the sheet-feed pathway 12. The pair of registration rollers 23 are for synchronizing timing of sheet transport with transfer of toner images formed on the photosensitive drum 6 onto the sheets. The pair of timing rollers 24 are for correcting any skew in sheets after the sheets abut against the pair of registration rollers 23.

Trays 32, 33 for accommodating printed sheets are provided in the sheet handling section 29. Pathways 30, 31 are formed in the sheet handling section 29 for connecting the sheet-discharge pathway 13 with the trays 32, 33.

A first path gate 27 is disposed near a divergence point P (shown in FIG. 4) where the sheet-feed pathway 12 diverges into the sheet-discharge pathway 13 and the return pathways 14A, 14B. The first path gate 27 is for transporting sheets selectively to either the sheet-discharge pathway 13 or the return pathways 14A, 14B. It should be noted that a sheet sensor 53 is attached to the main casing 2 at a position directly upstream from the first path gate 27. The sheet sensor 53 detects when the trailing edge of a sheet passes by the sheet sensor 53 and outputs a detection signal accordingly to a control portion (not shown).

A second path gate 28 is provided along the sheet-discharge pathway 13. The second path gate 28 is for transporting sheets that were transported to the sheet-discharge pathway 13 selectively to either the face-down pathway 15 or the face-up pathway 16.

Next, a transport pathway switching mechanism will be described with reference to FIGS. 4 and 5. The sheet-feed pathway 12 is defined by sheet guides 35, 36. The sheet guide 35 is detachably attached to the main casing 2. The sheet guide 36 is fixed on the main casing 2 at a position confronting the sheet guide 35. The first return pathway 14A is defined by a pair of mutually confronting sheet guides 39, 40, which are both fixed to the main casing 2. The second return pathway 14B is defined by a pair of mutually confronting sheet guides 41, 42, which are both fixed to the main casing 2.

The first path gate 27 includes a pair of upstream-side gate members 43 and also a sub gate member 50. The upstream-side gate members 43 are disposed upstream from the divergence point P for the sheet-discharge pathway 13 and return pathways 14A, 14B. The pair of upstream-side gate members 43 includes an upper-side gate member 44 and a lower-side gate member 47, which are disposed in confrontation with each other.

The upper-side gate member 44 includes a pivot shaft 46 and a gate member 45. The pivot shaft 46 is rotatable with respect to the sheet guide 35, which is detachable from the main casing 2 as mentioned above. The gate member 45 extends downstream, that is, with respect to the sheet transport direction, from the pivot shaft 46.

The lower-side gate member 47 includes a pivot shaft 49 and a gate member 48. The pivot shaft 49 is provided pivotable with respect to the main casing 2 and is located at a position that, with the pivot shaft 46, sandwiches the sheet-feed pathway 12. The gate member 48 extends downstream from the pivot shaft 49. It should be noted that the divergence point P can be alternately referred to as the position of the free ends of the gate members 45, 48.

The sub gate member 50 includes a pivot shaft 52 and a gate member 51. The pivot shaft 52 is positioned directly upstream from the first return pathway 14A and the sheet-discharge pathway 13 and downstream from the divergence point P. The gate member 51 is pivotable around the pivot shaft 52 and extends upstream with respect to the sheet transport direction. The gate member 51 does not contact any of the sheet guides 35, 36, 37, or 38 regardless of the pivot posture of the gate member 51. Rather, a space sufficient for allowing a sheet to pass therethrough is always opened between the gate member 51 and the sheet guides 35, 36, 37, or 38. As will be described later, the subgate member 50, the upper-side gate member 44, and the lower-side gate member 47 all pivot substantially simultaneously in substantially the same direction.

Next, a drive transmission mechanism and a linking mechanism for moving the upper-side gate member 44, the lower-side gate member 47, and the subgate member 50 back and forth will be described. A stepping motor 54 for supplying forward and reverse rotation force is provided on the main casing 2. A motor gear 55 is fixed on the output shaft of the stepping motor 54. A gate cam gear 56 meshingly engaged with the motor gear 55 is pivotably supported on the main casing 2. A stopper 56A is provided concentrically on the gate cam gear 56 so as to protrude axially outward from the gate cam gear 56. A subgate arm 58 is provided integrally with the subgate member 50 and extends from the pivot shaft 52 in substantially the opposite direction than the gate member 51. A cam roller 57 is rotatably supported on the gate cam gear 56 so as to contact the subgate arm 58. A pulling spring 59 is provided for constantly urging the subgate arm 58 toward the cam roller 57. However, the subgate arm 58 abuts against the stopper 56A when gate cam gear 56 rotates counterclockwise, because the cam roller 57 moves upward accordingly around the rotational axis of the gate cam gear 56. A rib 48A extends from the gate member 48 of the lower-side gate member 47. A link 60 is provided for connecting the rib 48A and the subgate arm 58. The pulling spring 59 is mounted between the rib 48A and the main casing 2 so as to constantly urge the gate member 48 to pivot in the clockwise direction of FIG. 4. Accordingly, through the connection of the link 60, the subgate arm 58 and the gate member 51 of the subgate member 50 are constantly urged to pivot clockwise and the subgate arm 58 is constantly urged toward the cam roller 57.

The linking mechanism includes a compression spring 61 and an abutment member 62. The compression spring 61 is interposed between the detachable sheet guide 35 and the upper-side gate member 44 and constantly urges the upper-side gate member 44 downward toward the lower-side gate member 47. The abutment member 62 protrudes from the lower-side gate member 47 toward the upper-side gate member 44 and is located away from (to the side of) the pathway of transported sheets. The abutment member 62 serves to maintain a gap between the upper-side gate member 44 and the lower-side gate member 47 against the urging force of the compression spring 61. When the lower-side gate member 47 is pivoted clockwise, the upper-side gate member 44 also pivots clockwise against the urging force of the compression spring 61. In this way, the linking mechanism functions to pivot the upper-side gate member 44 and the lower-side gate member 47 linkingly in the same pivot direction and also to constantly maintain a fixed space between the upper-side gate member 44 and the lower-side gate member 47 to enable a sheet to pass between the upper-side gate member 44 and the lower-side gate member 47.

Next, the operation of the transport pathway switching mechanism will be explained. FIG. 4 shows the transport pathway switching mechanism in the condition for transporting sheets that have been printed on one side with an image toward the return pathways 14A, 14B. FIG. 5 shows the transport pathway switching mechanism in a condition for guiding sheets toward a sheet discharge pathway.

Figure 4:
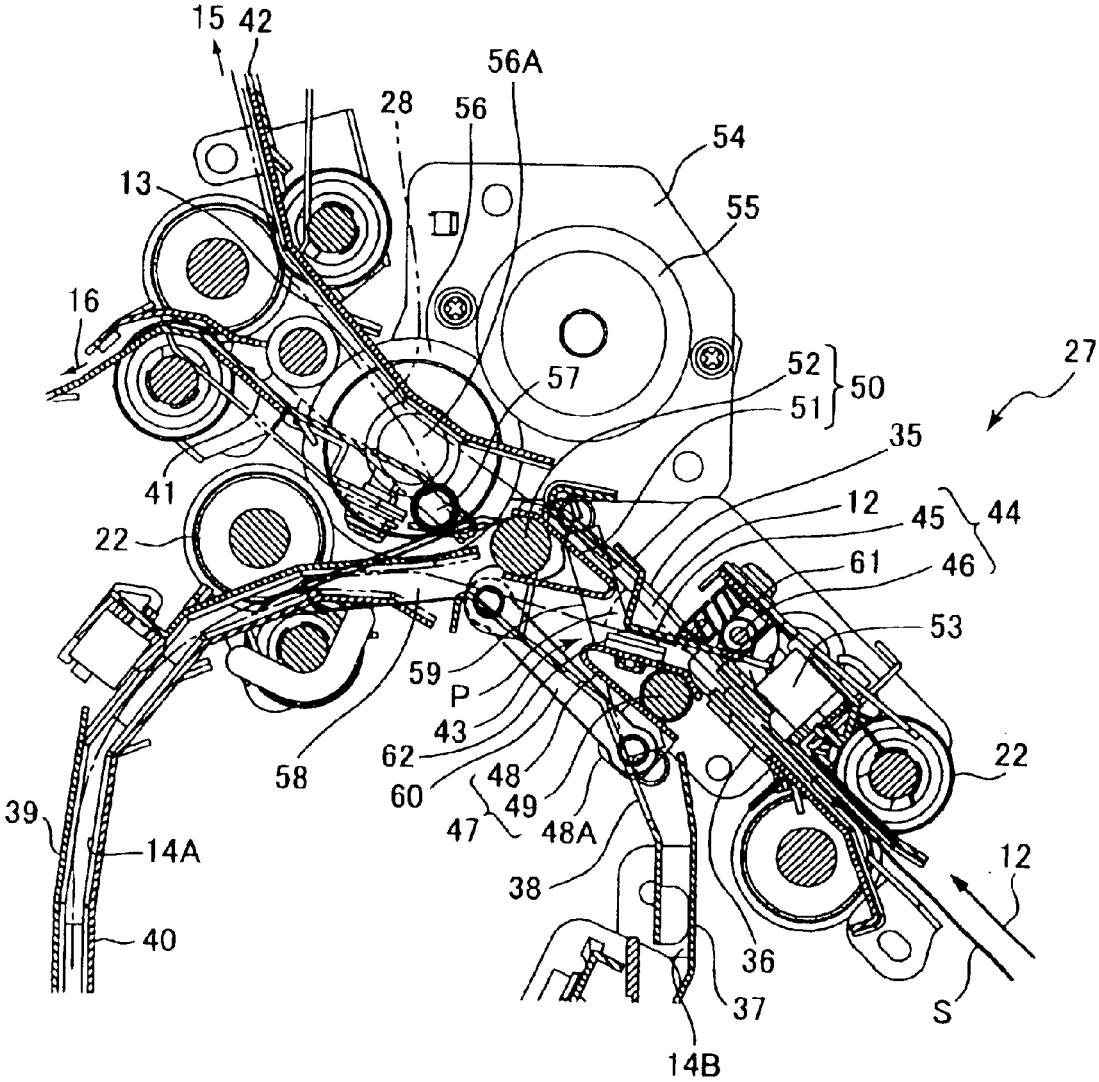
FIG. 4 is a side view showing a transport pathway switching mechanism of the printer of FIG. 3 in a condition for guiding sheets toward a sheet return pathway.
Figure 5:
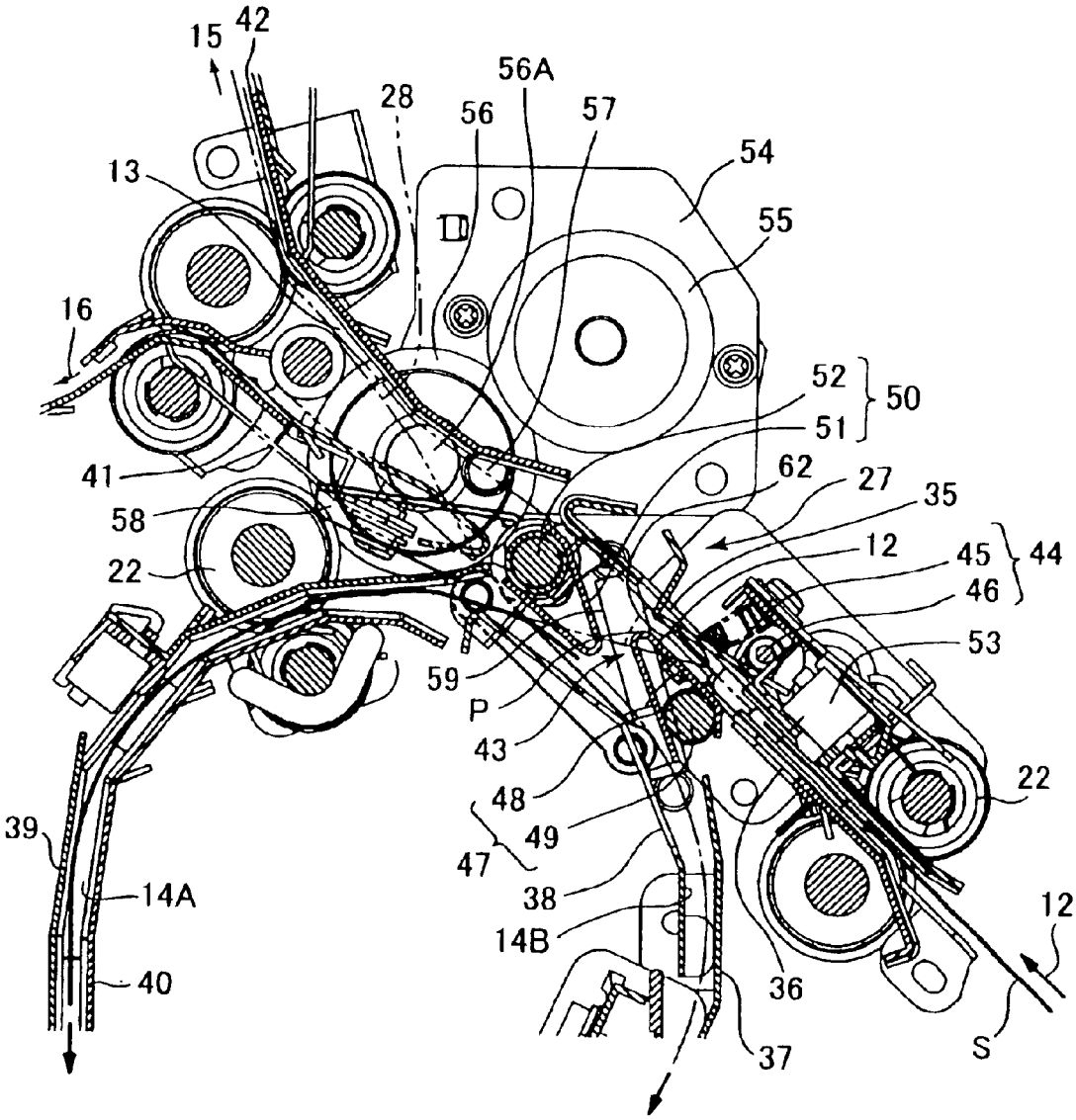
FIG. 5 is a side view showing the transport pathway switching mechanism of FIG. 4 in a condition for guiding sheets toward a sheet discharge pathway.

First, an explanation will be provided for switching the transport pathway switching mechanism from the condition of FIG. 5 to the condition of FIG. 4. When the stepping motor 54 rotates forward while the transport pathway switching mechanism is in the condition in FIG. 4, the gate cam gear 56 pivots clockwise and the cam roller 57 presses the subgate arm 58 downward. The subgate arm 58 and the gate member 51 of the subgate member 50 pivot counterclockwise as a result. By this, a large space is opened between the gate member 51 and the sheet guide 38 as shown in FIG. 4 so that sheets can be guided toward the first return pathway 14A. Note that the gate member 51 does not abut against the guide sheet guide 35 even after pivoting fully toward the sheet guide 35. Therefore, even if the preceding sheet is still being transported from the sheet-discharge pathway 13, the preceding sheet will not be pinched between the gate member 51 and the sheet guide 35 so that paper jams can be prevented.

At this time, the counterclockwise pivoting movement of the subgate arm 58 is transmitted to the gate member 48 of the lower-side gate member 47 through the link 60. As a result, the gate member 48 also pivots counterclockwise against the urging force of the pulling spring 59. Under the urging force of the compression spring 61, the gate member 45 of the upper-side gate member 44 follows the movement of the gate member 48 and so pivots counterclockwise also. As a result, a sheet S that is being transported from the sheet-feed pathway 12 is guided toward the first return pathway 14A. With this configuration, the subgate member 50 and the upstream-side gate members 43 (that is, the upper-side gate member 44 and the lower-side gate member 47) pivot simultaneously in the same direction. At this time, the pathway defined by the subgate member 50 and the sheet guide 38 form a funnel shape. Therefore, the subgate member 50 and the sheet guide 38 serve as an entryway for the first return pathway 14A and facilitate entry of sheets into the first return pathway 14A so that sheets are smoothly guided into the first return pathway 14A.

The sheet sensor 53 detects the trailing edge of the sheet as the sheet passes by the sheet sensor 53. The sheet sensor 53 outputs a detection signal accordingly to a control portion (not shown). The control portion includes a calculating unit (not shown) that, based on the detection signal from the sheet sensor 53, calculates when the trailing edge of the sheet will pass by the divergence point P. If the next sheet, that is, the sheet after the sheet detected by the sheet sensor 53, is also to be guided toward the first return pathway 14A, then the first path gate 27 is maintained in the same posture as shown in FIG. 4. On the other hand, if the next sheet is to be guided toward the sheet-discharge pathway 13, then the stepping motor 54 is rotated in reverse at the point in time that the calculating unit calculates that the trailing edge of the preceding sheet will pass by the divergence point P.

In this example, the next sheet is to be guided toward the sheet-discharge pathway 13. When the stepping motor 54 rotates in reverse, the motor gear 55 rotates in counter clockwise as viewed in FIGS. 4 and 5 and the cam roller 57 rises upward to the position shown in FIG. 5. As a result, the subgate arm 58 and the gate member 51 of the subgate member 50 pivot clockwise so that a large space is opened between the gate member 51 and the sheet guide 35. The sheet is guided through this large space toward the sheet-discharge pathway 13. Note that the gate member 51 does not contact the sheet guide 38, even after the gate member 51 has finished pivoting toward the sheet guide 38. Therefore, there is no danger of the preceding sheet, which was guided into the first return pathway 14A before the present sheet, getting pinched between the gate member 51 and the sheet guide 38. Therefore, paper jams can be prevented.

The clockwise pivoting movement of the subgate arm 58 continues until the subgate arm 58 abuts against the stopper 56A. During this time, the gate member 48 of the lower-side gate member 47 pivots clockwise via the link 60 into the posture shown in FIG. 5. When the gate member 48 pivots clockwise, the abutment member 62 presses the upper-side gate member 44 upward and clockwise against the urging force of the compression spring 61 into the posture shown in FIG. 5. This orientation of the lower-side gate member 47 and the upper-side gate member 44 guides sheets from the sheet-feed pathway 12 toward the sheet-discharge pathway 13. The sheet pathway defined by the subgate member 50 and the sheet guide 33 at this time forms a funnel shape that serves as the entrance for the sheet-discharge pathway 13. This facilitates entry of sheets so that sheets can be smoothly guided toward the sheet-discharge pathway 13.

In this way, the upper-side gate member 44 and the lower-side gate member 47 are positioned upstream from the divergence point P. Moreover, the subgate member 50 pivots within a range wherein the subgate member 50 will not block the sheet transport pathway. Therefore, by merely driving the stepping motor 54 a predetermined amount during the time interval from when the trailing edge of the sheet passes the divergence point P until the leading edge of a subsequent sheet reaches the divergence point P, the upper-side gate member 44 and the lower-side gate member 47 can be moved using the trailing edge of the sheet passing by the divergence point P as a trigger without waiting for the sheet to completely pass by the subgate member 50.

Also, the upper-side gate member 44 is provided on the detachable sheet guide 35 of the sheet-feed pathway 12. Therefore, even if a paper jam occurs, the user can easily use a sheet guide opening/closing mechanism (not shown) to detach the sheet guide 35. Because the upper-side gate member 44 moves integrally with the sheet guide 35, a space is opened below the lower-side gate member 47 that facilitates removal of the jammed sheet.

While the invention has been described in detail with reference to the specific embodiments thereof, it would be apparent to those skilled in the art that various changes and modifications may be made therein without departing from the spirit of the invention.

For example, the embodiment describes the sheet guide 35 as being detachable for the main casing 2. However, the sheet guide 35 can be provided openable/closable with respect to the main casing 2. Also, others of the sheet guides 36, 39, 40, 41, 42 could be detachable or openable/closable instead of or in addition to the sheet guide 35.

The embodiment describes the pulling spring 59 and the compression spring 61 as coil springs. However, other components can be used instead as long as they provide the desired urging force in the desired direction. For example, a torsion spring, a leaf spring, a rubber pulling spring, or a rubber compression spring can be used instead.

The embodiment describes using the stepping motor 54 as a source of drive force. However, other drive sources, such as a solenoid, can be used instead.

The embodiment describes the abutment member 62 as protruding from the lower-side gate member 47 toward the upper-side gate member 44. However, an abutment member can be fixed to the upper-side gate member 44 so as to protrude toward the lower-side gate member 47.

As described above, the upper-side gate member 44 and the lower-side gate member 47 pivot around points that are positioned upstream from the divergence point P and extend only downstream in the sheet transport direction. Further, the upper-side gate member 44 and the lower-side gate member 47 pivot simultaneously in the same direction. Therefore, the duration of time that the gate members 44, 47 cannot be pivoted can be reduced because only a small portion of the gate members 44, 47 is located downstream. That is, the upper-side gate member 44 and the lower-side gate member 47 can be pivoted for a subsequent sheet immediately from the point in time when the trailing edge of the preceding sheet passes by the upper-side gate member 44 and the lower-side gate member 47 so that the switching operation for the subsequent sheet can be performed in a short time. Accordingly, successive sheets can be transported with only a short intervening distance between them. Because the interval between successive sheets is minimal, more sheets can be transported per unit time without increasing the transport speed. Manufacturing costs can be suppressed. Also, sufficient time is available for switching orientation of the gate members.

The stepping motor 54 serves as a drive source for driving the upper-side gate member 44 to pivot clockwise and counterclockwise. The abutment member 62 and the compression spring 61 serve to link pivoting movement of the upper-side gate member 44 and the lower-side gate member 47. The motor gear 55, the gate cam gear 56, and the like serve to transmit the drive force from the stepping motor 54 to the upper-side gate member 44. With this configuration, there is no need to provide drive sources separately for the upper-side gate member 44 and the lower-side gate member 47. Also, the upper-side gate member 44 and the lower-side gate member 47 can be moved with precise synchronization.

The upper-side gate member 44 is attached to the sheet guide 35, which is detachable from the main casing 2. Therefore, even if a paper jam occurs, the jammed sheet can be easily removed by detaching the sheet guide 35 from the main casing 2 to separate the upper-side gate member 44 from the lower-side gate member 47.

The subgate member 50 is disposed downstream from and pivots in the same direction as the upper-side gate member 44 and the lower-side gate member 47. The cooperative operation of the subgate member 50, the upper-side gate member 44, and the lower-side gate member 47 ensures that sheets are selectively guided to the different pathways 13, 14 more smoothly.

A gap is opened between the subgate member 50 and the sheet guides 35, 36, 37, or 38 regardless of the pivot orientation of the subgate member 50. The gap is sufficiently large for a sheet to pass between the subgate member 50 and the sheet guides 35, 36, 37, or 38. Therefore, the subgate member 50 can be switched to guide a subsequent sheet toward one of the pathways 13, 14 while a preceding sheet passes through the other of the pathways 13, 14 without the preceding sheet becoming pinched between the subgate member 50 and the sheet guides 35, 36, 37, or 38. Sheet jams can be prevented.

The motor gear 55, the gate cam gear 56, and the like serve to transmit the drive force from the stepping motor 54 to subgate member 50. Therefore, the same drive source (i.e., the stepping motor 54) used for pivoting the upper-side gate member 44 and the lower-side gate member 47 clockwise and counterclockwise can be used for pivoting the subgate member 50. Only a single drive source is needed.

The link 60 gangingly links the subgate member 50 with the upper-side gate member 44. Therefore, the same drive source for pivoting the subgate member 50 can be used to pivot the upper-side gate member 44 as well through the motor gear 55, the gate cam gear 56, the subgate member 50, and the link 60.

The linking mechanism is made from a simple configuration including the compression spring 61 and the abutment member 62. Also, with this linking mechanism, the lower-side gate member 47 can be pivoted in synchronization with the upper-side gate member 44 by merely driving the upper-side gate member 44 to pivot.

What is claimed is:

1. An image forming device comprising:

an upstream-side sheet transport pathway;

a plurality of downstream-side sheet transport pathways that diverge from the upstream-side sheet transport pathway at a divergence point;

a pathway switching mechanism that, at the divergence point, selectively guides sheets transported following the upstream-side sheet transport pathway to one of the plurality of downstream-side sheet transport pathways, the pathway switching mechanism including:

a pair of upstream-side gate members and a gate member pivoting unit, the pair of upstream-side gate members including a pair of pivot shafts and a pair of gates, the pair of pivot shafts being disposed with the sheet transport pathway interposed therebetween, each of the pair of gates being pivotable around a corresponding one the pair of pivot shafts and extending substantially toward the downstream-side sheet transport pathways, the gate member pivoting unit pivoting the pair of gates substantially simultaneously and substantially in the same direction; and a downstream-side gate member pivotable in a same direction as the pair of upstream-side gates.

2. The image forming device as claimed in claim 1, wherein the gate member pivoting unit includes:

a drive unit that supplies drive force for driving at least one of the pair of upstream-side gate members to pivot selectively in a forward direction and a reverse direction;

a drive transmission mechanism that transmits the drive force from the drive unit to the at least one of the pair of upstream-side gate members; and a ganging mechanism that gangs pivoting movement of the at least one of the pair of upstream-side gate members with the other of the pair of upstream-side gate members.

3. The image forming device as claimed in claim 2, wherein the downstream-side gate member has a downstream-side pivot shaft and a downstream-side gate, the downstream-side pivot shaft being positioned directly upstream from the plurality of downstream-side sheet transport pathways and downstream from the divergence point, the downstream-side gate being pivotable around the downstream-side pivot shaft and extending substantially toward the upstream-side sheet transport pathway, the gate member pivoting unit pivoting the downstream-side gate and the pair of upstream-side gates in the same direction.

4. The image forming device as claimed in claim 3, wherein the drive transmission mechanism includes a first drive transmission mechanism that transits drive force from the drive unit to the downstream-side gate and pivots the downstream-side gate in a selected one of opposite directions.

5. The image forming device as claimed in claim 4, wherein the drive transmission unit further includes a second drive transmission mechanism that connects the downstream-side gate to one of the pair of upstream-side gate members to transmit pivoting movement of the downstream-side gate to the one of the pair of upstream-side gate members.

6. The image forming device as claimed in claim 5, further comprising:

a main casing; and a plurality of sheet guides that are attached to the main casing and that are disposed in opposition with each other with the upstream-side sheet transport pathway defined therebetween, at least one of the plurality of sheet guides being at least one of attachable/detachable and openable/closable with respect to the main casing and at least partially defining the upstream-side sheet transport pathway, one gate member of the pair of upstream-side gate members being assembled to the at least one of the plurality of sheet guides that is at least one of attachable/detachable and openable/closable;

wherein the ganging mechanism includes:

an urging member that is interposed between the at least one of the plurality of sheet guides and another of the pair of upstream-side gate members and that urges the other of the pair of upstream-side gate members toward the one of the pair of upstream-side gate members; and an abutment member for maintaining a gap between the pair of upstream-side gate members, the abutment member being fixed to the one of the upstream-side gates at a position that is between the pair of upstream-side gate members and that is separated from a surface of the one of the upstream-side gates along which sheets are transported.

7. The image forming device as claimed in claim 1, wherein the downstream-side gate member has a downstream-side pivot shaft and a downstream-side gate, the downstream-side pivot shaft being positioned directly upstream from the plurality of downstream-side sheet transport pathways and downstream from the divergence point, the downstream-side gate being pivotable around the downstream-side pivot shaft and extending substantially toward the upstream-side sheet transport pathway, the gate member pivoting unit pivoting the downstream-side gate and the pair of upstream-side gates in the same direction.

8. The image forming device as claimed in claim 1, wherein the pair of upstream-side gate members and the downstream-side gate member pivot substantially simultaneously in substantially the same direction.

9. The image forming device as claimed in claim 1, wherein:

the downstream-side gate member includes a pivot shaft and a gate member;

the pivot shaft is positioned upstream from the plurality of downstream-side sheet transport pathways and downstream from the divergence point;

the gate member is pivotable around the pivot shaft and extends upstream with respect to a sheet transport direction; and the gate member does not contact any sheet guides regardless of a pivot position of the gate member, the sheet guides are disposed in opposition with each other with the upstream-side sheet transport pathway defined therebetween.

10. The image forming device as claimed in claim 1, wherein a space sufficient for allowing a sheet to pass therethrough is always opened between the gate member and sheet guides that are disposed in opposition with each other with the upstream-side sheet transport pathway defined therebetween.

11. The image forming device as claimed in claim 1, further comprising a linking mechanism for moving the pair of upstream-side gate members and the downstream-side gate member back and forth.

12. The image forming device as claimed in claim 11, wherein the linking mechanism comprises:

a compression spring interposed between a detachable sheet guide and an upper-side gate member of the pair of gates, the compression spring urging the upper-side gate member downward toward a lower-side gate member of the pair of gates; and an abutment member protruding from the lower-side gate member toward the upper-side gate member and located away from the pathway of transported sheets, the abutment member serving to maintain a gap between the upper-side gate member and the lower-side gate member against the urging force of the compression spring.

13. The image forming device as claimed in claim 12, wherein, when the lower-side gate member is pivoted clockwise, the upper-side gate member pivots clockwise against the urging force of the compression spring such that the linking mechanism functions to pivot the upper-side gate member and the lower-side gate member linkingly in the same pivot direction and also to maintain a fixed space between the upper-side gate member and the lower-side gate member to enable a sheet to pass between the upper-side gate member and the lower-side gate member.

14. An image forming device comprising:

an upstream-side sheet transport pathway;

a plurality of downstream-side sheet transport pathways that diverge from the upstream-side sheet transport pathway at a divergence point;

a pathway switching mechanism that, at the divergence point, selectively guides sheets transported following the upstream-side sheet transport pathway to one of the plurality of downstream-side sheet transport pathways, the pathway switching mechanism including:

a pair of upstream-side gate members and a gate member pivoting unit, the pair of upstream-side gate members including a pair of pivot shafts and a pair of gates, the pair of pivot shafts being disposed with the sheet transport pathway interposed therebetween, each of the pair of gates being pivotable around a corresponding one the pair of pivot shafts and extending substantially toward the downstream-side sheet transport pathways, the gate member pivoting unit pivoting the pair of gates substantially simultaneously and substantially in the same direction;

a main casing; and a plurality of sheet guides that are attached to the main casing and that are disposed in opposition with each other with the upstream-side sheet transport pathway defined therebetween, at least one of the plurality of sheet guides being at least one of attachable/detachable and openable/closable with respect to the main casing and at least partially defining the upstream-side sheet transport pathway, one gate member of the pair of upstream-side gate members being assembled to the at least one of the plurality of sheet guides that is at least one of attachable/detachable and openable/closable.

15. An image forming device comprising:

an upstream-side sheet transport pathway;

a plurality of downstream-side sheet transport pathways that diverge from the upstream-side sheet transport pathway at a divergence point;

a pathway switching mechanism that, at the divergence point, selectively guides sheets transported following the upstream-side sheet transport pathway to one of the plurality of downstream-side sheet transport pathways, the pathway switching mechanism including:

a pair of upstream-side gate members and a gate member pivoting unit, the pair of upstream-side gate members including a pair of pivot shafts and a pair of gates, the pair of pivot shafts being disposed with the sheet transport pathway interposed therebetween, each of the pair of gates being pivotable around a corresponding one the pair of pivot shafts and extending substantially toward the downstream-side sheet transport pathways, the gate member pivoting unit pivoting the pair of gates substantially simultaneously and substantially in the same direction;

a main casing; and a plurality of sheet guides that are attached to the main casing and that are disposed in opposition with each other with the upstream-side sheet transport pathway defined therebetween, the gate member pivoting unit pivoting the downstream gate only into at least a first pivot posture and a second pivot posture, a space sufficiently large for a sheet to pass through being opened between the downstream gate and one of the sheet guides while the downstream gate is in the first pivot posture and between the downstream gate and another of the sheet guides while the downstream gate is in the second pivot posture, the downstream gate being in a non-intersecting, non-abutting condition with the sheet guides regardless of pivot posture.

16. An image forming device, comprising:

an upstream-side sheet transport pathway;

a plurality of downstream-side sheet transport pathways that diverge from the upstream-side sheet transport pathway at a divergence point; and a pathway switching mechanism comprising:

a pivotal upper side upstream gate member and a pivotal lower side upstream gate member positioned upstream from a divergence point leading to a plurality of downstream-side sheet transport pathways, the pivotal upper side upstream gate member and the pivotal lower side upstream gate member, upon pivoting, direct the sheets to one of the plurality of downstream-side sheet transport pathways; and a downstream-side gate member comprising a pivot shaft and a gate member, the pivot shaft being positioned upstream from the plurality of downstream-side sheet transport pathways and downstream from the divergence point, the gate member being pivotable around the pivot shaft and extending upstream with respect to a sheet transport direction, the gate member does not contact any sheet guides, which are disposed in opposition with each other with the upstream-side sheet transport pathway defined therebetween, regardless of a pivot position of the gate member.

17. The image forming device as claimed in claim 16, wherein the pivotal upper side upstream gate member and the pivotal lower side upstream gate member and the downstream-side gate member pivot substantially simultaneously in substantially the same direction.

* * * * *